US007029095B2

(12) United States Patent
Tsuboi et al.

(10) Patent No.: US 7,029,095 B2
(45) Date of Patent: Apr. 18, 2006

(54) INK JET PRINTING APPARATUS AND PRELIMINARY EJECTING METHOD

(75) Inventors: Hitoshi Tsuboi, Tokyo (JP); Katsuhiro Shirota, Kanagawa (JP); Noribumi Koitabashi, Kanagawa (JP); Yasunori Fujimoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/986,804

(22) Filed: Nov. 13, 2001

(65) Prior Publication Data

US 2002/0101472 A1 Aug. 1, 2002

(30) Foreign Application Priority Data

Nov. 13, 2000 (JP) ..... 2000-345771

(51) Int. Cl.
*B41J 2/165* (2006.01)

(52) U.S. Cl. ..... 347/35; 347/36; 347/23

(58) Field of Classification Search ..... 347/23, 347/30, 35, 17, 36; 134/18
See application file for complete search history.

(56) References Cited

U.S. PATENT DOCUMENTS

| | | | | |
|---|---|---|---|---|
| 4,791,435 A | * | 12/1988 | Smith et al. | 347/17 |
| 5,659,342 A | * | 8/1997 | Lund et al. | 347/35 |
| 5,942,043 A | * | 8/1999 | Suemune | 134/18 |
| 5,995,067 A | | 11/1999 | Terasawa et al. | 345/23 |
| 6,042,218 A | | 3/2000 | Nakahara | 347/35 |
| 6,109,724 A | | 8/2000 | Takahashi et al. | 347/23 |
| 6,299,277 B1 | * | 10/2001 | Fujii | 347/23 |
| 6,352,333 B1 | * | 3/2002 | Matsumoto et al. | 347/23 |

FOREIGN PATENT DOCUMENTS

| | | |
|---|---|---|
| EP | 0 326 428 A2 | 8/1989 |
| EP | 0 704 307 | 4/1996 |
| EP | 0 764 527 A2 | 3/1997 |

OTHER PUBLICATIONS

Michael C. Ferringer, et al.; "Color Maintenance Spitting Algorithm For Ink Jet Printers", Xerox Disclosure Journal, vol. 23, No. 3, May/Jun. 1998, p. 131.

* cited by examiner

*Primary Examiner*—Hai Pham
*Assistant Examiner*—Lam S. Nguyen
(74) *Attorney, Agent, or Firm*—Fitzpatrick Cella Harper & Scinto

(57) ABSTRACT

The present invention provides an ink jet printing apparatus and a preliminary ejecting method. In both a full-line and a serial printer, the amount of ink passing through nozzles of print heads is sometimes decreased below a normal value before and during actual printing, In the printer of present invention, a preliminary ejecting operation is performed taking the opportunity in which the amount of ink passing through nozzles is decreased below a normal value. Then, the amount of ink passing through nozzles recovers to the normal value at an ink ejection after the preliminary ejecting operation. Since only a small amount of ink is ejected through the nozzles during the preliminary ejection operation, dots formed on a print sheet are not noticeable. Further, it is unnecessary to move the print heads to a home position where an ejection recovering process is executed to remove ink having an increase viscosity.

25 Claims, 10 Drawing Sheets

| FIG.5A | FIG.5B |
|---|---|

LAST PRINTED IMAGE

DOT PATTERN FORMED DURING PRELIMINARY EJECTING OPERATION

| FIG.8A | FIG.8B |
|---|---|

INK JET PRINTING APPARATUS AND PRELIMINARY EJECTING METHOD

This application is based on Patent Application No. 2000-345771 filed Nov. 13, 2000 in Japan, the content of which is incorporated hereinto by reference.

BACKGROUND OF THE INVENTION

1. Field of the Invention

The present invention relates to an ink jet printing apparatus and a preliminary ejecting method, and more particularly to a preliminary ejecting operation for preventing a defective ejection from a print head.

2. Description of the Related Art

If no ink is ejected from a print head of an ink jet printing apparatus such as an ink jet printer for a certain time or longer, then the viscosity of ink in nozzles increases to cause a defective ejection. In particular, the recent trend to eject finer ink droplets leads to a relative increase in the effect of the viscosity on ink ejection, as well as a reduction of ejection energy. Thus, the defective ejection caused by an increase in the viscosity of ink tends to be more serious.

Ejection recovering processes are known which prevent such a defective ejection. The ejection recovering process is executed at predetermined timings or when the temperature, printing duty, and the like of the printing apparatus meet predetermined conditions.

A well-known ejection recovering process is so-called a suction recovery process that sucks ink through the nozzles of the print head to forcibly discharge and remove ink having an increased viscosity (high viscosity). Another well-known ejection recovering process is a pressurization recovery process that pressurizes inside the print head to discharge ink through the nozzles in contrast to the suction recovery process. Furthermore, a more simple known ejection recovering process is so-called a preliminary ejecting operation that discharges ink having the increased viscosity by executing a predetermined number of ejections to a predetermined location of the printing apparatus, the ejections eventually having no contribution with the printing. Such a preliminary ejecting operation is relatively frequently executed because it is simple and does not require much time.

In a serial-type printing apparatus that executes printing by scanning a print head over a print sheet, the print head is generally moved to a predetermined location outside a printing area, where the preliminary ejecting operation is performed. On the other hand, so-called a full-line printing apparatus is known which executes printing while transporting a print sheet relative to a print head having nozzles arranged within a range corresponding to the width of the print sheet. In the case that a plurality of print sheets are continuously transported for printing by the full-line printing apparatus, a preliminary ejecting operation is performed on an area different from the print sheet, for example, on a transport belt. In these conventional cases, several tens of ejections (several tens of droplets) are executed to appropriately remove ink having the increased viscosity during the preliminary ejecting operation.

The preliminary ejecting operation is often performed each time a predetermined amount of printing is completed. For the serial printing apparatus, the preliminary ejecting operation is performed, for example, at the intervals of a predetermined number of scanning operations or after each printing process for one page. In this case, the print head is moved to an ink receiver provided at a predetermined location where a preliminary ejecting operation is performed. On the other hand, for the full-line printing apparatus, a preliminary ejecting operation is performed on the transport belt as described above after a printing process for one page has been completed and before the next page is printed.

Such a conventional preliminary ejecting operation enables defective ejections to be prevented regardless of the degree of an increase in the ink viscosity, which varies in the nozzles. That is, ink is not ejected through some of the nozzles according to print data, and the ink in these nozzles undergoes a significant increase in viscosity. On the other hand, ink in nozzles continuously ejecting may not be subjected to an increase in viscosity. In spite of such a variation in the degree of the increase in viscosity among the nozzles, by performing the above preliminary ejecting operation at a predetermined timing, defective ejections can be appropriately prevented without any configuration for detecting the degree of the increase in viscosity of each nozzle.

However, in the serial printing apparatus, the print head is moved to the predetermined location before performing the above-described preliminary ejecting operation. This requires an amount of time including that required to move the print head, thereby possibly hindering the throughput of the printing apparatus from being improved. On the other hand, in the full-line printing apparatus, a relatively large amount of ink is ejected to the belt during the preliminary ejecting operation. Thus, the conventional full-line printing apparatus requires a separate cleaning mechanism to remove the relatively large amount of ink from the belt.

In order to solve the above problems, a method until now has been known which ejects ink to, for example, an area on a print medium such as a print sheet where no image is formed. However, with this method, several tens of ink droplets are ejected during the conventional preliminary ejecting operation, so that a relatively large amount of ink droplets adhere to the print medium. Accordingly, dots formed by ink droplets removed from the nozzles are easily perceived in an image formed on the same print medium, thereby possibly degrading the entire image.

It is an object of the present invention to provide an ink jet printing apparatus and a preliminary ejecting method that can solve the above-described problems of the conventional preliminary ejecting operation, that is, a decrease in throughput or the necessity of a separate cleaning mechanism.

SUMMARY OF THE INVENTION

The inventors have noted that the amount of ink passing through a nozzle or the concentration thereof may decrease at the first ejection or the first and subsequent several ejections following the last one though only time much shorter than the interval for conventional ejecting operation has passed since the last ejection.

Of these phenomena, a decrease in the amount of ink ejected (first phenomenon) has until now been seen only at the first ejection or the first and second ejections executed when the above much shorter time has elapsed since the last ejection. It has also been confirmed that the amount of ink ejected has a normal (regular) value at the second or third ejection after the last ejection. This is presumably because a film is formed on the surface of ink meniscus in the vicinity of the nozzle during the time much shorter than the interval for the conventional preliminary ejecting operation. That is, after the film has been formed, its resistance reduces the size of ink droplet provided by the first ejection or substantially prohibits ink from being ejected. It is assumed that the film is removed by the first ejection, thereby allowing ink droplets of a normal (regular) size to be obtained at the second and subsequent ejections.

The above-described decrease in the amount of ink ejected at the first ejection or the first and second ejections causes a kind of defective ejection. If such a defective ejection is executed during an actual image printing process, dots formed by ink droplets ejected through the nozzle of the print head at the first ejection or the first and second ejections will not have a desired size or no dots may be formed. Thus, if an image composed of black characters or the like is to be printed, the image quality may be degraded, for example, the contour of the image may not be sharp.

On the other hand, it has been confirmed that the optical density of dots formed by ink ejected may decrease (second phenomenon) in the case that a pigment is used as a color material of ink. That is, in the case of using ink containing the pigment as the color material, the pigment concentration of ink ejected may decrease at the first ejection or the first several ejections executed after a certain time has elapsed since the last ejection. As a result, the optical density of dots formed by the ink ejected is reduced. It has also been confirmed that the concentration of the ink recovers to a normal value after the first ejection or the first and subsequent several ejections. Further, it has been ascertained that as in the case with the first phenomenon, such a decrease in the optical density occurs after the last ejection from the nozzle and within time much shorter than the interval for the conventional ejecting operation. This second phenomenon degrades the image on the print medium as in the case with a decrease in the amount of ink ejected resulting from the formation of the film.

The formation of the film associated with the first phenomenon has long been known. Thus, attempts have been made to use ink having such a composition as prevents a thin film due to the increased viscosity of the ink from being formed on the surface of ink in the vicinity of the nozzle within a short time (order of several seconds). However, the limitation of the ink to such a composition that prevents the film from being formed during a short time may reduce the degree of freedom of an apparatus design for improving the printing grade. For example, in the case that the film is unlikely to be formed on the surface of ink under atmosphere in the vicinity of the nozzles, it is difficult to restrain the evaporation of moisture (ink solvent). Thus, with large ejection intervals, the ink viscosity increases to cause a thicker film to be formed, thereby making it difficult to recover normal ejection or increasing the concentration of ink above the normal value at the first ejection. Eventually, this leads to the use of ink having such a composition that the thin film is formed during a short time (several seconds).

With respect to each of the nozzles in the print head, it should be understood that the above-described first and second phenomena may occur at opportunities other than the first ejection or the first several ejections when a predetermined amount, for example, one page of printing is to be started. During several seconds after the start of printing, the ink may not be ejected through some of the nozzles according to print data. Thus, the above-described film formation or decrease in concentration may occur in these nozzles.

The inventors examined the above two phenomena in detail and solved the above problems by performing a preliminary ejecting operation utilizing these phenomena.

One aspect of the present invention relates to an ink jet printing apparatus. The ink jet printing apparatus comprises a print head having a nozzle and can perform a preliminary ejecting operation. The preliminary ejecting operation is executed to recover a normal ejection, and does not contribute to printing. The amount of ink ejected through the nozzle in the print head may vary depending on the time during which no printing process is executed. In view of this point, in this ink jet printing apparatus, the preliminary ejecting operation is performed taking an opportunity in which the amount of ink passing through the nozzle is decreased below a normal value.

Further, another aspect of the present invention relates to an ink jet printing apparatus that can execute printing with ink containing a pigment as a color material. The ink jet printing apparatus comprises a print head having a nozzle and can perform a preliminary ejecting operation that does not contribute to printing. An optical density obtained from a pigment concentration of ink ejected through the nozzle in the print head may vary depending on the time during which no printing process is executed. In view of this point, in this ink jet printing apparatus, the preliminary ejecting operation is performed taking an opportunity in which the optical density obtained from the pigment concentration of ink passing through the nozzle is decreased below a normal value.

Further, the present invention provides a preliminary ejecting method for an ink jet printing apparatus comprising a print head having a nozzle, the apparatus being capable of performing a preliminary ejecting operation that does not contribute to printing, the method comprising a step of:

(a) executing the preliminary ejecting operation taking an opportunity in which the amount of ink passing through the nozzle is decreased below a normal value, if the amount of ink varies depending on the time during which no printing process is executed.

Another aspect of the present invention provides a preliminary ejecting method for an ink jet printing apparatus comprising a print head having a nozzle, the apparatus being capable of executing a printing process using ink containing a pigment as a color material, and performing a preliminary ejecting operation that does not contribute to printing, the method comprising a step of:

(a) executing the preliminary ejecting operation taking an opportunity in which the optical density obtained from the concentration of ink passing through the nozzle is decreased below a normal value, if the optical density varies depending on the time during which no printing process is executed.

According to the present invention, the preliminary ejecting operation is performed taking an opportunity to reduce the amount of ink ejected, thereby reducing the amount of ink ejected during the preliminary ejecting operation below the normal value. Further, the preliminary ejecting operation is performed taking an opportunity to reduce the optical density, thereby reducing the optical density obtained from the ink ejected during the preliminary ejecting below the normal value. Consequently, if the preliminary ejecting operation is performed on a print medium, dots formed on the print medium by this operation will not be so conspicuous. Further, the opportunity to reduce the amount of ink ejected or the optical density generally corresponds to a small number of ejections executed after a certain time has elapsed since the last ejection. Typically, the preliminary ejecting operation corresponds to the first ejection or the first several ejections following the last one. Therefore, the amount of ink ejected during the preliminary ejecting operation can be reduced.

The above and other objects, effects, features and advantages of the present invention will become more apparent from the following description of embodiments thereof taken in conjunction with the accompanying drawings.

DETAILED DESCRIPTION OF PREFERRED EMBODIMENTS

A preferred embodiment of the present invention will be described below in detail with reference to the drawings.

Figure 1A:
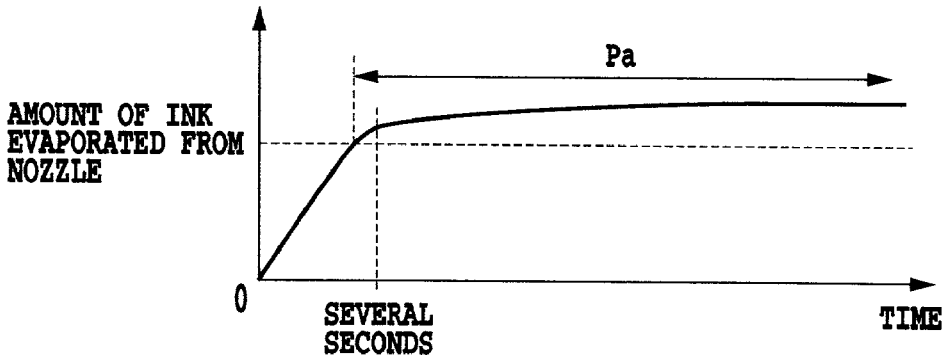
FIG. 1A and FIG. 1B are graphs illustrating a decrease in the amount of ink ejected and a decrease in ink concentration respectively, both of which are utilized for a preliminary ejecting operation according to the present invention.
Figure 1B:
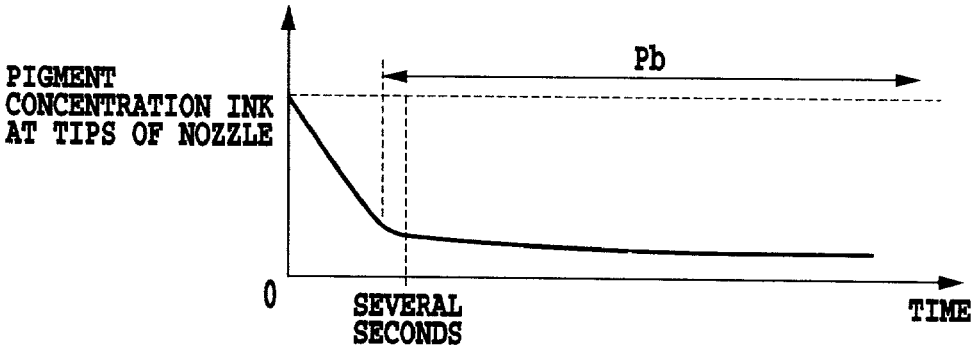

FIGS. 1A and 1B are graphs showing a variation in the amount of ink solvent evaporated and a variation in the concentration of a pigment in ink present in the vicinity of nozzles, vs. an elapsed time after the last ejection through each of nozzles in a print head respectively.

As shown in FIG. 1A, the evaporation of moisture in the ink progresses within a relatively short time on the order of several seconds after the last ejection, but subsequently the amount of moisture evaporated does not significantly increase. It can be considered that a thin film is formed on the surface of the ink, which forms meniscus, within time (several seconds) much shorter than the interval for the conventional preliminary ejecting operation and the film then serves to reduce the subsequent evaporation. Such a film formed within several seconds can be basically removed by a single ejection(first ejection). Subsequently, the second and subsequent ejections allow a normal (regular) amount of ink to be obtained unless the above-described short time (several seconds) elapses before the next ejection.

Here, the "ejection" essentially means an operation performed to provide a predetermined (normal) amount of ink whether or not a desired amount of ink (ink droplets of a desired size) is eventually obtained.

More particularly, during a period "Pa" shown by an arrow in FIG. 1A, though a decreased amount of ink (ink droplet of reduced size) is obtained by the first ejection, a desired (normal) amount of ink is obtained by the second and subsequent ejections executed in a driving cycle for actual image printing after the first ejection. The period "Pa" is shorter than the interval for conventional preliminary ejecting operation, but has a certain time interval.

A preliminary ejecting operation according to one embodiment of the present invention is performed at any timing within the period "Pa" and after the several seconds during which the amount of ink ejected decreases. The preliminary ejecting operation is performed to remove ink having an increased viscosity (high viscosity) or the above-described film and does not contribute to printing. Basically, a single ejection is carried out during the preliminary ejecting operation.

The time interval of the period "Pa" shown by the arrow in FIG. 1A, ejecting numbers (number of ejections) and the amount of ink ejected of the preliminary ejecting operation according to the embodiment of the present invention are not fixed but vary in accordance with various conditions. That is, an opportunity for performing the preliminary ejecting operation can be determined in accordance with various conditions.

For example, the film that may be formed in the nozzle is likely to be thick depending on a temperature or humidity condition for the printing apparatus or on the composition of ink. In such a case, a single ejection may not be sufficient to break the film, and for example, two or more ejections may be required. In this case, twice ejections are performed as the preliminary ejecting operation within the period "Pa" to obtain the normal amount of ink by the third and subsequent ejections. Further, ejecting numbers for the preliminary ejecting operation required to obtain a normal amount of ink ejected may increase linearly with the elapsed time after the last ejection. That is, a plurality of periods Pa during which the preliminary ejecting operation can be performed may be present depending on ejecting numbers required to obtain the normal amount of ink ejected. In such a case, one of the plural periods Pa may be selected which contains a suitable timing for the preliminary ejecting operation that can be set in a target printing apparatus. Then, ejecting numbers required to recover the normal amount of ink ejected, which corresponds to the selected period "Pa", may be determined as one for the preliminary ejecting operation.

Essentially, the embodiment of the present invention is based on an ink jet printing apparatus having an opportunity in which the amount of ink passing through the nozzle decreases below a normal value, such as the above first ejection or the first and subsequent several ejections following the last one. The ink jet printing apparatus according to the present invention performs the preliminary ejecting operation utilizing the opportunity in which the amount of ink ejected decreases.

In the embodiment of the present invention, the above-described preliminary ejecting operation is performed on a print medium. That is, in the printing apparatus of the present invention, the print head (nozzle) is opposite to the print medium for the preliminary ejecting operation. During the preliminary ejecting operation according to the embodiment of the present invention, one or several droplets of ink pass through the nozzles, and are smaller than ones for actual printing. Thus, basically, dots formed on the print medium by the preliminary ejecting operation are not so conspicuous.

According to the present invention, the opportunity in which the amount of ink ejected decreases and the period (time interval) during which such a state lasts are examined beforehand, as described later. Further, timing at which the print head is located opposite to the print medium being transported is determined on the basis of conditions such as the speed at which the printing apparatuses transports the print medium and the ejection frequency of the print head. On the basis of the determined conditions, timing at which the preliminary ejecting operation is to be performed is set so as to eject the ink onto the print medium.

FIG. 1B is a graph relating another embodiment of the present invention, showing how a concentration of pigment in ink decreases. As shown in FIG. 1B, during several seconds after the last ejection, the pigment concentration in ink decreases relatively rapidly in the vicinity of the nozzles. After the several seconds have elapsed, the decrease in concentration slows down. Even in such a pigment ink concentration decrease phenomenon, shown in FIG. 1B, a period "Pb" shown by an arrow in the figure, is present as in the case with the above-described decrease in the amount of ink ejected resulting from the formation of the film. During the period "Pb", the pigment concentration of ink is decreased at the first ejection but recovers a normal one at the second and subsequent ejections. However, in this pigment concentration decrease phenomenon, even within the period "Pb", ejecting numbers required to recover the normal concentration increases with the elapsed time after the last ejection, and thus varies. It can be considered that ink having a decreased pigment concentration gradually extends from the vicinity of the nozzle tip to the interior of an ink passage as the time elapses, thereby precluding all the ink having a decreased pigment concentration from being discharged by a single ejection.

Thus, in this embodiment, timing for the preliminary ejecting operation is determined so that the operation is performed within the predetermined period "Pb" and after the several seconds during which the pigment concentration (optical density of dot) decreases. Then, ejecting numbers required to recover the normal concentration for the set timing is determined for the preliminary ejecting operation. The timing for the preliminary ejecting operation is determined depending on whether the print head (nozzles) is opposite to the print medium or another location (such as a transport belt) or according to other conditions.

In this case, the time interval of the period "Pb", the corresponding ejecting numbers for the preliminary ejecting operation, and the like vary depending on various conditions as in the case with a decrease in the amount of ink ejected resulting from the formation of a film.

Thus, this embodiment is based on an ink jet printing apparatus having an opportunity in which the concentration of the ink passing through the nozzle decreases below a normal value, such as the above first ejection or the first and subsequent several ejections following the last one. The ink jet printing apparatus according to the present invention performs the preliminary ejecting operation utilizing the opportunity for ejection in which the concentration of ink passing through the nozzle decreases.

It has already been confirmed that the pigment concentration of ink in the vicinity of the nozzle decreases, but the reason has not been clarified. However, it can be assumed in the following manner. That is, the pigment is not easily soluble in ink solvent, and thus becomes less dispersive as the ink solvent (moisture) is evaporated. Thus, the pigment is dispersed to an ink supply source having a larger amount of moisture and located apart from an outlet of the ink passage. Further, the pigment becomes more dispersive on a side of the ink passage being closer to an ejecting heat element having a higher temperature. As a result, it is assumed that the pigment is dispersed from the nozzle toward the heating element.

Figure 2:
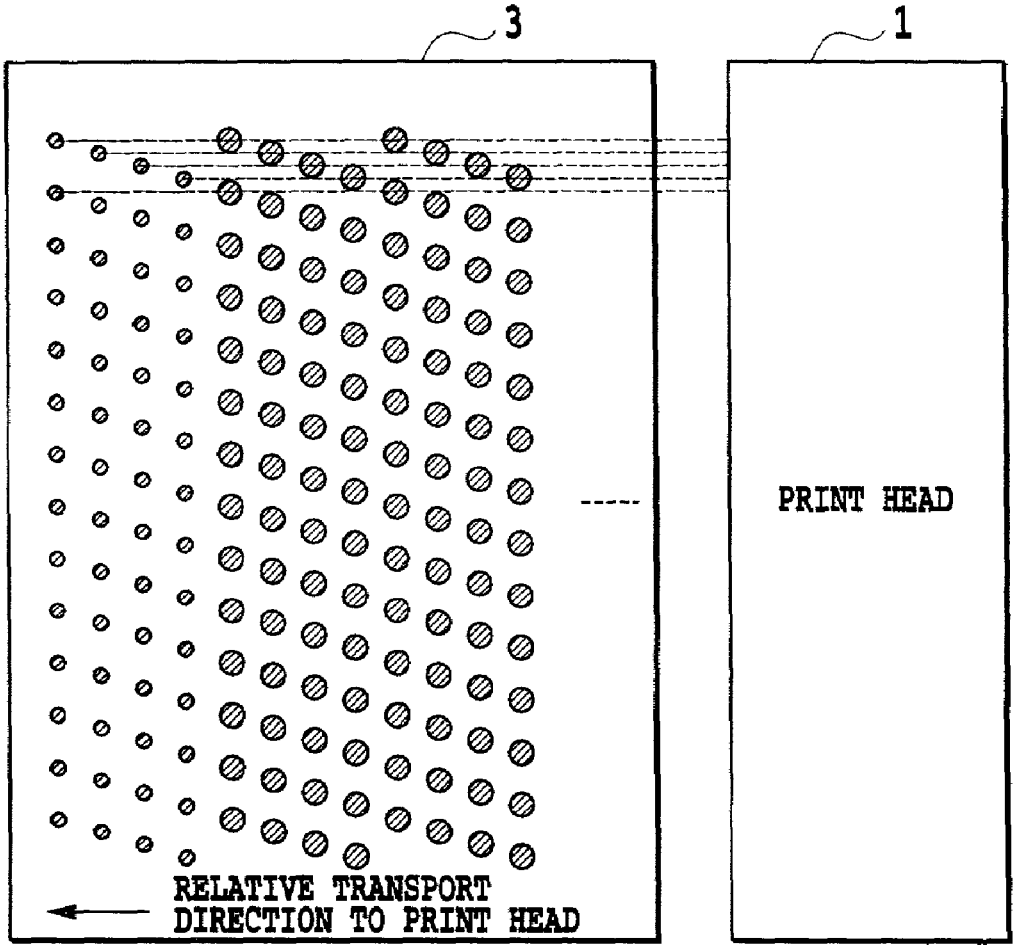
FIG. 2 is a schematic view showing an ejecting pattern used in one embodiment of the present invention in order to determine a particular ejection till which a decrease in the amount of ink ejected continues.

FIG. 2 is a view illustrating how to determine the timing and the ejecting numbers for the preliminary ejecting operation according to the embodiment of the present invention. This figure illustrates a dot pattern formed on the print medium by the ink ejected from a print head 1. The print head 1 has many nozzles arranged in a line. These nozzles are divided into four groups every four nozzles. That is, a first group includes Nos. 1,5,9,13 . . . nozzles, a second group includes Nos. 2,6,10,14 . . . nozzles, a third group includes Nos. 3,7,11,15 . . . nozzles, and a fourth group includes Nos. 4,8,12,16 . . . nozzles. The pattern of FIG. 2 can be formed by causing each group to eject the ink at predetermined intervals.

To determine the timing and the ejecting numbers (number of ejection) for the preliminary ejecting operation, a plurality of dot patterns such as shown in FIG. 2 are prepared. When preparing each of dot patterns, the elapsed time between once ejection and next ejection for each group of nozzles. A plurality of such elapsed times are measured. The plurality of elapsed times measured each corresponds to the elapsed time after the last ejection and before the first ejection following it as described above. Then, while the print medium 3 is being transported at a transportation speed for actual printing, the ink is ejected through each group of nozzles (last ejection). Then, after the above elapsed time, the ejection is resumed (first ejection). Subsequently, the ink is sequentially ejected through the respective nozzles in an ejection cycle for actual printing. As a result, a plurality of patterns such as the one shown in FIG. 2 are created.

On the basis of these patterns created in the above manner, a particular ejection till which the amount of ink ejected continues to decrease after the resumption of the ejection and the period of the decrease in the amount of ink ejected can be determined. In the example shown in FIG. 2, each of the dots formed by the first ejection through each group of nozzles has a smaller size, but each of the dots formed by the second ejection has a normal size. This indicates that the amount of ink ejected decreases only at the first ejection. Accordingly, ejecting numbers for the preliminary ejecting operation can be determined atone. Further, by examining the above-described elapsed time for the plurality of dot patterns in which each of the dots created by the first ejection have a smaller size, the period within which the amount of ink ejected decreases at the first ejection is determined. Then, a predetermined time within this period is set as timing for the preliminary ejecting operation considering the configuration of the printing apparatus and the like (for example, timing when the interval between sheets shown in FIG. 3 appears).

A manner of determining timing and ejecting numbers for the preliminary ejecting operation to deal with a decrease in the pigment concentration of ink (FIG. 1B) is generally similar to the manner executed to deal with a decrease in the amount of ink ejected. In this case, ejecting numbers for the preliminary ejecting operation is not determined on the basis of the size of dots but on a decrease in the optical reflection density of dots on the print medium or the like.

Since the dot pattern shown in FIG. 2 is a collection of dots formed by each predetermined group of nozzles, areas with a reduced dot size and with a normal dot size can be compared together; both areas are relatively large. Accordingly, the difference between these areas can be easily recognized. This comparison is carried out, for more detailed examinations, by visual inspections using a magnifying glass or by a reading process using a scanner or the like.

As described above, the state of the film on the surface of the ink varies depending on the environmental temperature or humidity of the printer. Therefore, the time required before the normal amount of ink ejected or the normal concentration being recovered by ejections of the predetermined numbers is assumed to vary depending on the environmental temperature or humidity of the printer. Similarly, the number of ejections with the decreased amount of ink ejected or the decreased concentration is assumed to vary depending on the environmental temperature or humidity of the printer. Thus, in this embodiment of the present invention, the above-described predetermined time as the timing for the preliminary ejecting operation and the ejecting numbers for the preliminary ejection operation are examined beforehand on the basis of the temperature and humidity of the environment by the above-described manner. On the basis of the results of the examination, a table for the predetermined time (interval) and ejecting numbers corresponding to the temperature and humidity is prepared. During actual printing, the preliminary ejecting operation is performed with reference to this table.

Further, a plurality of such tables can be prepared for the start of printing and for actual printing. At the start of printing, a certain time is required after a detachment of a cap from the print head and to wait for print data from a host apparatus. These times effect a change in the time required before the normal amount of ink ejected or the normal concentration is recovered by the ejection of the predetermined numbers, and the number of ejection with the decreased amount of ink ejected or the decreased concentration. Thus, for the start of printing, a dedicated table indicative of the ejection numbers is prepared and used. To create this table, the number of ejections with the decreased amount of ink ejected or the decreased concentration is examined beforehand in the above manner, on the basis of the elapsed time before the actual printing and the humidity and temperature. An ejecting numbers table for the start of printing corresponding to the temperature and humidity is created on the basis of the results of the examination.

Alternatively, the conditions can be simplified when the tables prepared. If it is assumed that the printer is used in, for example, an environment conditioned to have a temperature of 20° C. and a humidity of 30 to 70% at which human beings can live comfortably, the range of one or both of the temperature and humidity of the environment around the printer can be generally estimated. Accordingly different tables free from data such as the temperature may be provided for the start of printing and continuous printing.

The above two embodiments will be described below in detail with reference to several specific variations.

(First Variation)

Figure 3:
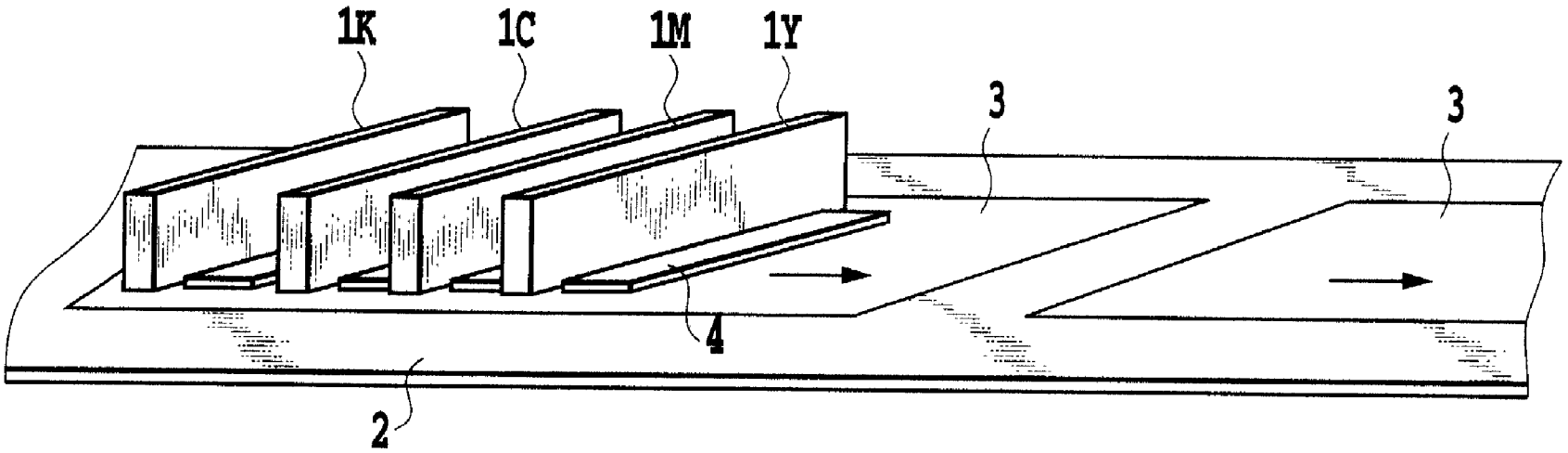
FIG. 3 is a perspective view schematically showing a full-line printer according to one variation of the embodiment of the present invention.

FIG. 3 is a perspective view showing a configuration of an ink jet printer according to a variation of the embodiment of the present invention.

The printing apparatus according to the variation of the present invention is an ink jet printer. The apparatus is so-called a full-line printer comprising a print head having a plurality of nozzles disposed in a line over a range that is substantially equal to the width of the largest print medium used in the printer. This printer ejects ink on a print medium to record an image thereon while the medium is being transported with respect to the print head. As shown in FIG. 3, the printer of this variation includes print heads 1K, 1C, 1M, and 1Y each having a plurality of nozzles arranged over a range that is substantially equal to the width of print medium 3. The print heads 1K, 1C, 1M, and 1Y eject black (K), cyan (C), magenta (M), and yellow (Y) inks, respectively, through the corresponding nozzles. Each of the print heads has an electrothermal converting element for each nozzle and uses thermal energy generated by these electrothermal converting elements to generate bubbles in the ink, thereby ejecting the ink through the nozzles by the pressure of the bubbles. The print medium 3 is held on a transport belt 2 by, for example, electrostatic suction. Thus, the print medium 3 is transported while remaining flat. Depending on print data, ink is ejected from the print heads 1K, 1C, 1M, and 1Y on the print medium 3 transported in the above manner, thereby recording an image thereon.

While printing is not executed, the print heads are moved upward in the figure using a mechanism (not shown), and caps 4 are slid to under the corresponding print heads. Subsequently, the print heads are lowered so as to cap the nozzles. The capping prevents evaporation of the solvent in ink in the vicinity of the nozzles of the print head. Further, before the start of printing, a pressurization recovery process or a suction recovery process is executed for the nozzles capped. The pressurization recovery process pressurizes the interior of the print head pressurized to discharge ink from the ink passage through the nozzles. By the suction recovery process, the interior of the cap is set to a negative pressure to discharge the ink from the ink passage. The recovery process may be based on both pressurization and suction. Subsequently, a wiping member wipes off the ink remaining on a nozzle-side surface of each print head.

In this variation, a preliminary ejecting operation is performed which is associated with the decrease in the amount of ink ejected resulting from the formation of the film as described in FIG. 1A in addition to the ejection recovery process including capping, pressurization or suction recovery process, and wiping. Specifically, the above-described tables are provided for each of the print heads 1K, 1C, 1M, and 1Y. During printing, the preliminary ejecting operation is performed on the basis of an elapsed time and ejecting numbers corresponding to the temperature and humidity of the printer environment. At the start of printing, the preliminary ejecting operation is performed on the basis of ejecting numbers corresponding to the temperature and humidity.

That is, the full-line printer of this variation requires about two to three seconds to print one print sheet. Further, the decrease in the amount of ink ejected resulting from the formation of the film occurs within time on the order of several seconds as described above. In view of these points, in this variation, a printer control procedure and tables are determined such that a single preliminary ejecting operation is performed while one print sheet is being printed, as described later in FIGS. 5A and 5B. Accordingly, in this variation, even if an ejecting interval varies among the nozzles depending on print data, the decrease in the amount of ink ejected does not occur before one page is entirely printed. In this full-line printer, the preliminary ejecting operation is managed for the entire print head and not for each of the nozzles. Ejecting numbers for the preliminary ejecting operation depends on the temperature and humidity, but the ejecting numbers is set at one or two (one or two droplets) in this variation. Timing for the preliminary ejecting operation is set so that this operation (ejection that does not contribute to printing) is performed within an appropriate period (time interval) to allow the amount of ink ejected to return to the normal value by the above-described one or two ejections. Further, the preliminary ejecting operation is performed immediately before an image starts to be printed on the transported print medium.

Further, at the start of printing, as described later in FIGS. 5A and 5B, the preliminary ejecting operation is controlled on the basis of another table to eject the ink onto the print sheet.

The composition of the ink used in this variation will be listed below.

| | |
|---|---|
| [Yellow (Y) ink] | |
| C.I. direct yellow 86 | 3 pts. |
| Glycerin | 5 pts. |
| Diethyleneglycol | 5 pts. |
| Acetylenol EH (manufactured by Kawaken Fine Chemicals) | 1 pt. |
| Water | Remaining parts |
| [Magenta (M) ink] | |
| C.I. acid red 289 | 3 pts. |
| Glycerin | 5 pts. |
| Diethyleneglycol | 5 pts. |
| Acetylenol EH (manufactured by Kawaken Fine Chemicals) | 1 pt. |
| Water | Remaining parts |
| [Cyan (C) ink] | |
| C.I. direct blue 199 | 3 pts. |
| Glycerin | 5 pts. |
| Diethyleneglycol | 5 pts. |
| Acetylenol EH (manufactured by Kawaken Fine Chemicals) | 1 pt. |
| Water | Remaining parts |
| [Black (K) ink] | |
| Food black 2 | 4 pts. |
| Glycerin | 6 pts. |
| Triethyleneglycol | 5 pts. |
| Acetylenol EH (manufactured by Kawaken Fine Chemicals) | 1 pt. |
| Water | Remaining parts |

Figure 4:
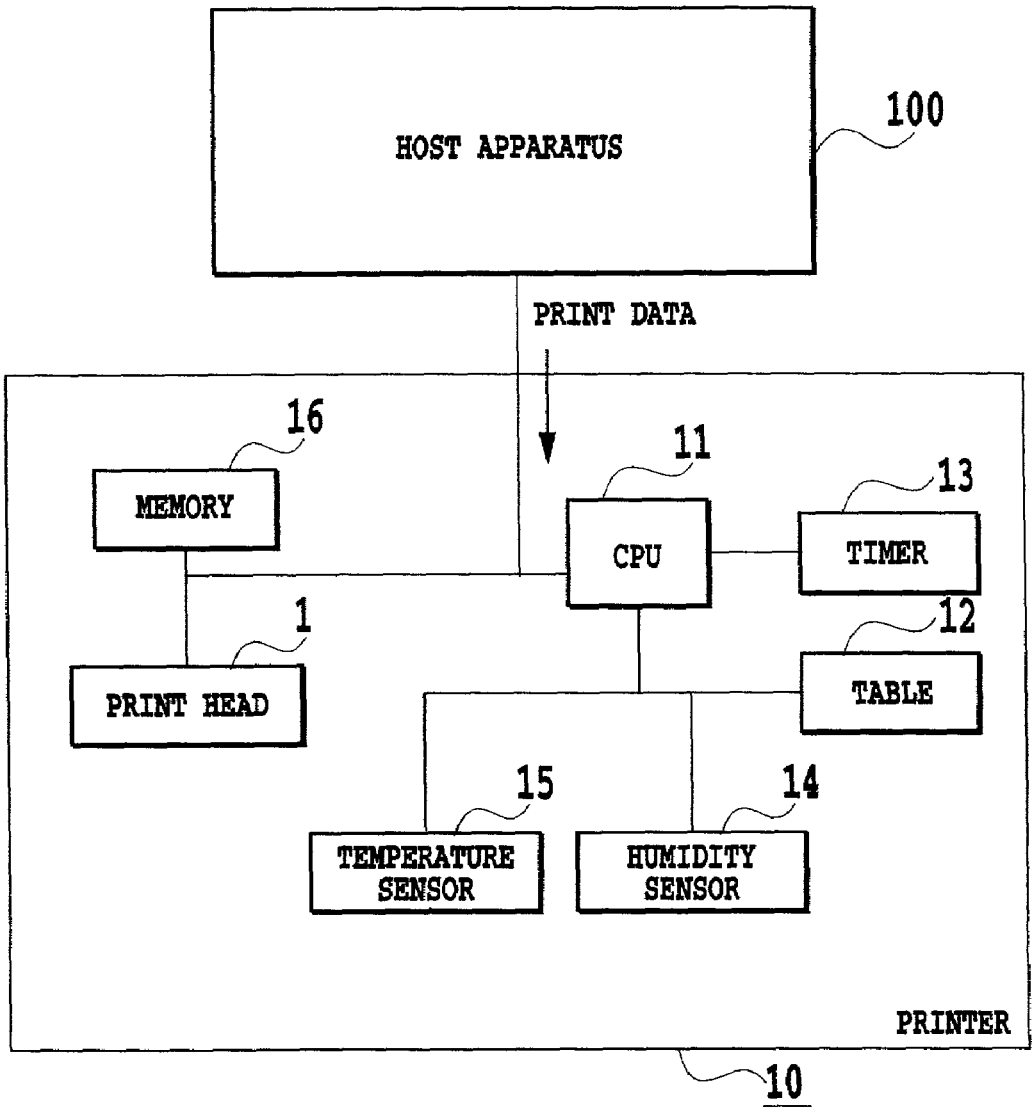
FIG. 4 is a block diagram showing a control system of the printer in FIG. 3, which is particularly associated with the preliminary ejecting operation thereof.

FIG. 4 is a block diagram showing a control system of the ink jet printer of FIG. 3 according to this variation, the arrangement being specifically associated with the preliminary ejecting operation.

As shown in FIG. 4, the printer 10 of this variation executes printing on the basis of print data transmitted from a host apparatus such as a personal computer. Print data from the host apparatus 100 is stored in a memory 16 such as a RAM under the control of a CPU 11. In this variation, the transferred print data is in the form of binary data that has undergone predetermined image processing in the host apparatus 100. Once print data for one print sheet has been transferred, the print head 1 (1K, 1C, 1M, and 1Y) is driven, while the transportation belt 2 is controlled to record an image on the print medium 3.

As described later in FIGS. 5A and 5B, before the printing process is performed, a humidity sensor 14 and a temperature sensor 15 detect humidity and temperature respectively under the control of the CPU 11. The CPU 11 refers to one of the tables 12 on the basis of the detected humidity and temperature to determine a predetermined time (interval) for the preliminary ejecting operation and ejecting numbers (the number of ink droplets ejected) for the printing ejecting operation. Once the time counted by a timer 13 reaches the predetermined time, the printer 10 performs the preliminary ejecting operation on the print sheet 3. Further, at the start of printing, the preliminary ejecting operation is performed with ejecting numbers determined on the basis of another table regardless of the interval of the operation. That is, in this variation, the two tables 12 are created; one of them is used during actual printing, whereas the other is used at the start of printing. The table used during actual printing provides correspondences between both the temperature and humidity and both the interval (predetermined time) and ejecting numbers of the preliminary ejecting operation. On the other hand, the table used at the start of printing provides correspondences between both the temperature and humidity and ejecting numbers for the preliminary ejecting operation performed before the start of actual printing.

Figures 5, 5A:
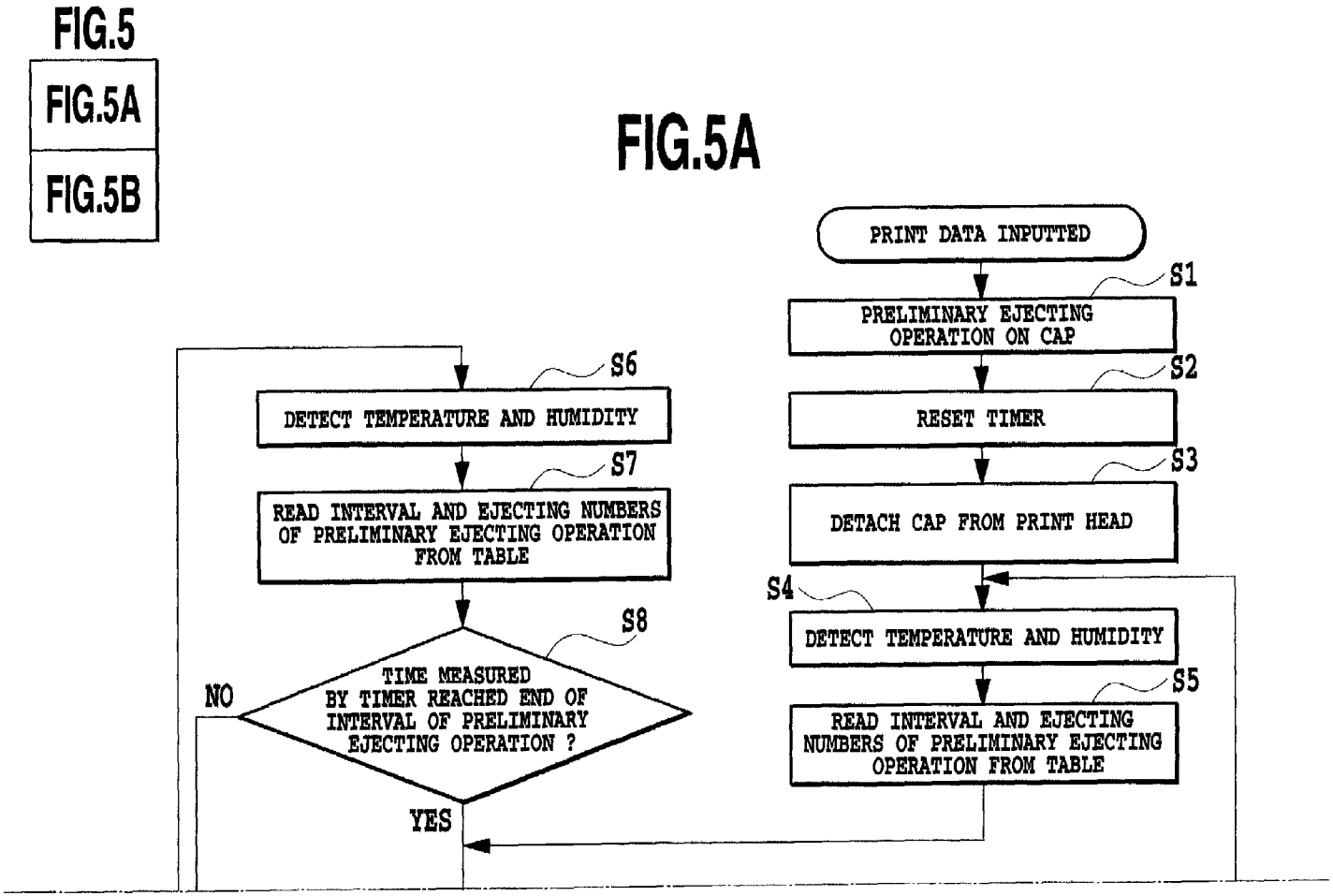
FIG. 5 is a diagram showing the relationship between FIG. 5A and FIG. 5B.
FIGS. 5A and 5B are flowcharts showing the control of the preliminary ejecting operation according to one variation of the embodiment of the present invention.
Figure 5B:
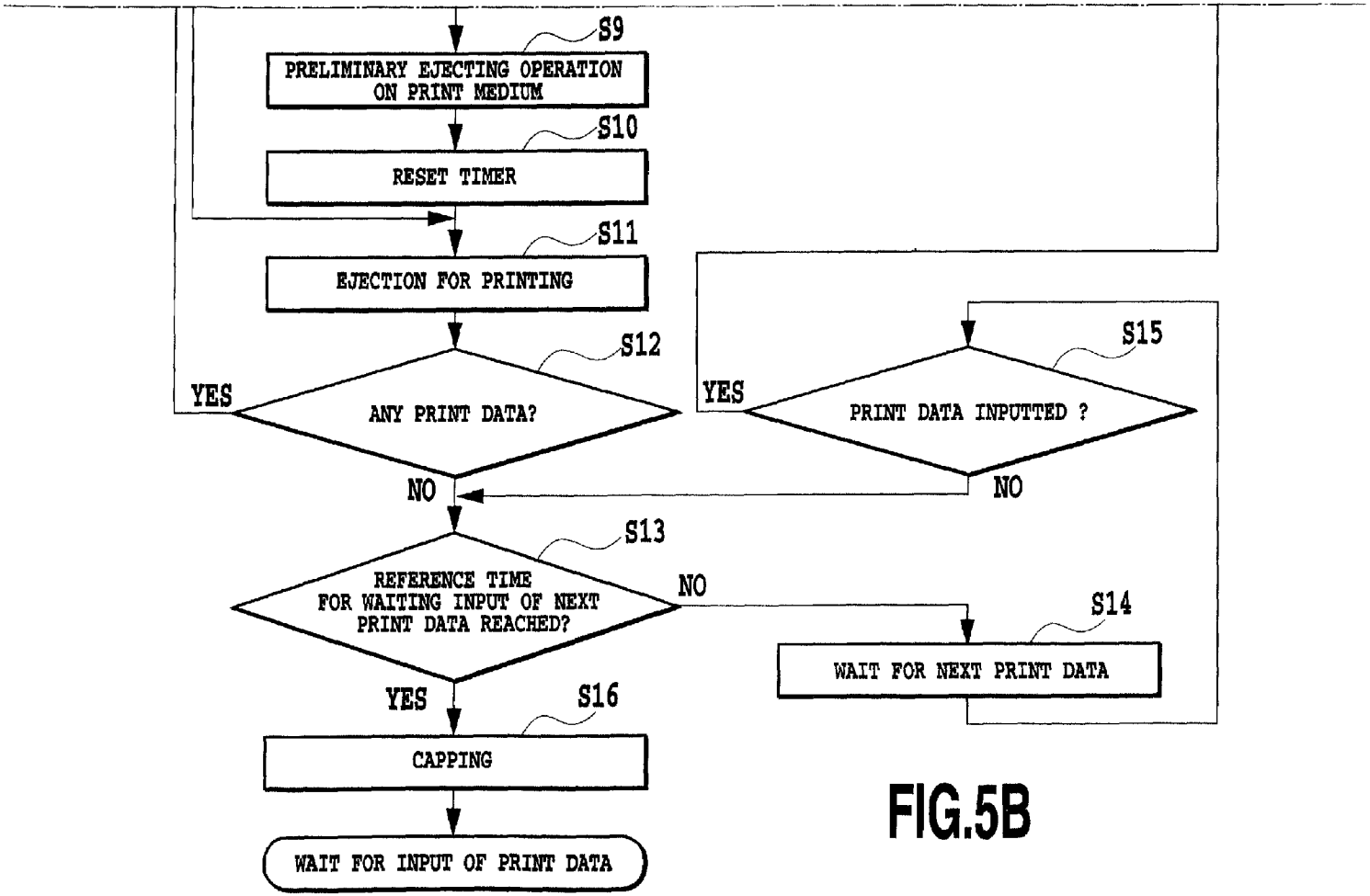

FIGS. 5A and 5B are flowcharts showing the process procedure of the preliminary ejecting operation according to this variation.

The following process is started when the printer 10 receives print data from the host apparatus 100. First, in step S1, the preliminary ejecting operation is performed on the caps located opposite the respective print heads. This preliminary ejecting operation is similar to the conventional one and removes ink with an increased viscosity resulting from the lack of ink ejection for time much longer than the time required for the above-described film to be formed. This film formation can be prevented by the preliminary ejecting operation according to this variation.

Next, in step S2, the timer 13 for the preliminary ejecting operation according to this variation is reset and starts counting the time elapsing after the preliminary ejecting operation of step S1. Then, in step S3, the cap unit is driven to detach the cap from the print head. Subsequently, the print head is lowered to approach the print head 3, thereby allowing the print head to perform printing on print sheet by ejecting the ink through the nozzles. Concurrently with the operation of the print head, the print sheet 3 starts to be transported by the transport belt 2.

Then, in step S4, the temperature sensor 15 and the humidity sensor 14 detect the temperature and humidity of the atmosphere of the printer 10 respectively. In step S5, on the basis of the detected temperature and humidity, data of ejecting numbers for the next preliminary ejecting operation is read out from the table for the start of printing. Then, in step S9, the preliminary ejecting operation causes each print head to eject the ink onto the print sheet 3 through all the nozzles predetermined ejecting numbers (for example one or two). This preliminary ejecting operation is performed because about several seconds are required before printing is actually started owing to a series of operations required to start printing such as the above-described clearing of the cap. That is, as described in FIG. 1A, after the preliminary ejecting operation in step S1 and before printing is actually started, the amount of ink ejected may decrease in some nozzles because of the film formed on the surface of ink. This preliminary ejecting operation is performed in order to remove the film and/or ink with an increased viscosity from these nozzles.

In this variation, the preliminary ejecting operation is performed with an appropriate ejecting numbers to return the amount of ink ejected, which has decreased before the actual printing, to the normal value. In this case, the time required after the clearing of the cap and before the print sheet is transported to the position of the print head is fixed. Thus, the table used in this case provides only data of ejecting numbers for the preliminary ejecting operation, which is based on the temperature and humidity. With reference to this table, ejecting numbers for this preliminary ejecting operation is determined so that the determined number of ejections are executed on the print sheet.

On the other hand, during actual printing, the print heads eject the ink onto the print medium 3 according to print data, thereby forming a predetermined image on the print medium (step S11). Once an ejecting based on one line of data corresponding to the arrangement of the nozzles in the print head is completed, it is determined whether or not there is any subsequent line of print data (step S12). If there is any data to be printed, then in step S6, the temperature and humidity are detected as in step S4. Then, in step S7, the timing and ejecting numbers for the next preliminary ejecting operation are read out from the table used during actual printing. The table used during printing provides ejecting numbers for the preliminary ejecting operation as well as the interval (predetermined time) of the operation required to set a timing for the preliminary ejecting operation. That is, this table indicates correspondences between both the temperature and humidity and both ejecting numbers and the interval (above-described predetermined time) for the preliminary ejecting operation.

During actual printing, the same print data may be continuously printed on a plurality of print media (print sheets 3). In such a case, the above-described interval is set so that the preliminary ejecting operation is performed for each page. In step S8, it is determined whether or not the elapsed time after the last preliminary ejecting operation has reached the read-out interval of the preliminary ejecting operation. Then, when the preliminary ejecting operation is to be performed, in step S9, ink ejection of the read-out numbers is performed on the print sheet 3. In other words, the printer of this variation performs the preliminary ejecting operation with number of ejections corresponding to the ejecting state in which the amount of ink passing through the nozzle decreases below the normal value. For example, the printer performs the preliminary ejecting operation with one ejection on each page. As a result, the film in the nozzles causing the decrease in amount of ink ejected as described in FIG. 1A is removed. Thus, the amount of ink ejected subsequently returns to the normal value. In this variation, the interval of the preliminary ejecting operation during actual printing is stored in the table so that the amount of ink ejected after the preliminary ejection can have the normal value if a single preliminary ejecting operation (with one ejection) is performed on each page.

If there is a subsequent line of print data, the operations in steps S6, S7, S8, and S11 are repeated in order to process the print data on the print sheet 3 (step S12). On the other hand, the next print data may be the same print data as that in the last ejection as in the case with continuous printing. In this case, once one page has been entirely printed, in step S8, it is determined that the elapsed time after the last preliminary ejecting operation has reached the end of the interval of the preliminary ejecting operation. If the elapsed time has reached the end of the interval, the preliminary ejecting operation is performed in step S9. After this operation, the timer 13 is reset in step S10, and the next page starts to be printed in step S11.

There are different cases from the continuous printing. For example, printing may be executed while waiting for each page of print data to be transmitted from the host apparatus. In such a case, in step S13, the standby time required before input of next print data is measured after one page has been entirely printed. Then, it is determined whether or not the standby time has reached a predetermined reference time. If the printer 10 receives next data from the host apparatus 100 before this reference time is reached (steps S14 and S15), the preliminary ejecting operation for the start of printing is performed in steps S4, S5, and S9. That is, the reference time in step S13 can be set so that a decrease in the amount of ink ejected which may occur within this reference time can be prevented by the above-described preliminary ejecting operation for the start of printing.

On the other hand, in step S13, if the standby time to wait for input of next print data reaches the reference time, the cap unit is driven in step S16 because the apparatus will not execute printing for relatively long time. Thus, the cap is attached to each print head to allow the procedure to wait for print data to be input.

As described above, ejection numbers of the preliminary ejecting operation of this variation is limited to the number of the ejecting state in which the amount of ink passing through the nozzle decreases below the normal value. The preliminary ejecting operation of the present invention allows only a very small amount of ink to pass through the nozzles. Such a preliminary ejecting operation enables the prevention of defective ejections that can hitherto be dealt with mainly by the ejection recovering process that requires a relatively large amount of ink to be ejected. That is, the preliminary ejecting operation of this variation is performed taking an opportunity to decrease or substantially zero the volume of ink ejected due to the presence of the film formed on the ink surface within a relatively short time. During such a preliminary ejecting operation, the amount of ink ejected is minimized, whereas the amount of ink ejected can be returned to the normal value after the preliminary ejecting operation. Furthermore, the preliminary ejecting operation of this variation substantially reduces the necessity of the periodic ejection recovering process requiring a large amount of ink to be ejected during a single operation as in the prior art. Further, the preliminary ejecting operation can be performed on the print medium such as print sheet. By ejecting ink to the print medium such as print sheet during the preliminary ejecting operation as in this variation, the transport belt is prevented from being contaminated with ink. This allows to omit or simplify a mechanism for removing ink from the transport belt, thereby making it possible to make the apparatus compact and restrain an increase in costs.

Furthermore, the preliminary ejecting operation of this variation allows only a smaller amount of ink to be ejected through the nozzles than that of the normal ejecting operation (ejection for print). Therefore, dot of very small size is formed on the print medium by the preliminary ejecting operation. During the preliminary ejecting operation, the ink is often ejected through each nozzle one or two times, so that in most cases, one or two dots are formed on the print medium. As a result, dots formed on the print medium during the preliminary ejecting operation are essentially not very noticeable and do not degrade a printed image. Furthermore, by varying the timing for the preliminary ejecting operation for each of the nozzles in the print head, dots formed on the print medium during the preliminary ejecting operation can be made more unnoticeable. For example, by providing random time differences with timings of the preliminary ejecting operation, random dot pattern may be formed during the preliminary ejecting operation. Further, as described in detail in the following sub-variation, these time differences may be determined using a dither matrix. Thus, the dot pattern may be formed during the preliminary ejecting operation according to dither patterns.

The setting for the timing (predetermined time) of the preliminary ejecting operation can be varied depending on the ink characteristics as well as the above-described environmental conditions such as the temperature and humidity. The characteristics often vary in the colors of ink. Further, even in the same color, inks may have different characteristics depending on the concentration of their color materials such as pigments. Accordingly, the interval of the preliminary ejecting operation may be set for each of colors so as to correspond to the ink characteristics.

The printer 10 is preferably designed so that the time required after the cap has been detached from the print head and before printing is started or the time interval between transported print sheets is several seconds (about 2–10 seconds). Because, the film formed within 2–10 seconds can be removed by a small number of ejections of the preliminary ejecting operation as described above. Thus, the number of ejections executed during the preliminary ejecting operation for the start of printing or for the leading one of a plurality of pages to be printed can be minimized to one or two.

(Sub-variation of the First Variation)

In the above-described first variation, the interval of the preliminary ejecting operation is not managed for each of the nozzles but for the entire print head. As described above, the apparatus with a full-line print head has a very large number of nozzles. So, if the interval of the preliminary ejecting operation is determined for each of the nozzles, control of the ejecting interval using a timer or the like will be complicated and time-consuming. Thus, the managing the interval of the preliminary ejecting operation for the entire print head has the advantage of simplifying the control arrangement. However, a full-line printer for printing images on A0- or A1-sized print sheets, which are larger than A4-sized print sheets typically used at offices or homes, requires a relatively long time to print one page (one sheet). In this case, in those of the nozzles through which the ink has not been ejected according to the print data, the film may be formed and become thick in the nozzles while one page is being printed. The thickened film may not be removed by one or two ink ejections. For these nozzles, the amount of ink ejected cannot be returned to a normal value by the preliminary ejecting operation with number of ejections corresponding to the ejecting state in which the amount of ink ejected decreases. In this case, the conventional preliminary ejecting operation should be performed which requires a relatively large number of ejections.

Figure 6A:
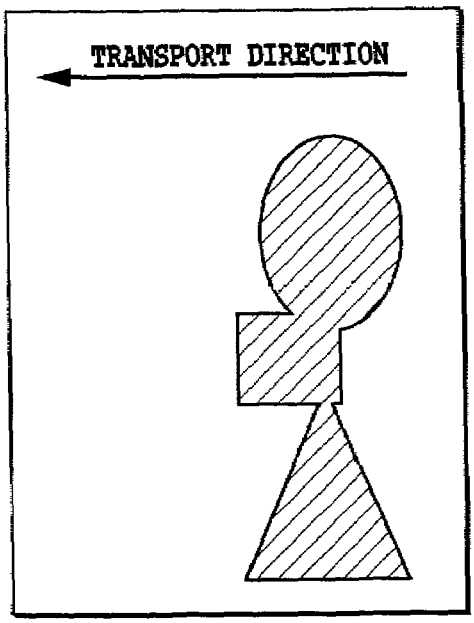
FIGS. 6A and 6B are views respectively showing an example in which the contour of a printed image in one page forms a pattern on the next page by a preliminary ejecting operation, the views illustrating a state that may occur if the preliminary ejecting operation according to one variation of the embodiment of the present invention is preformed for each nozzle.
Figure 6B:
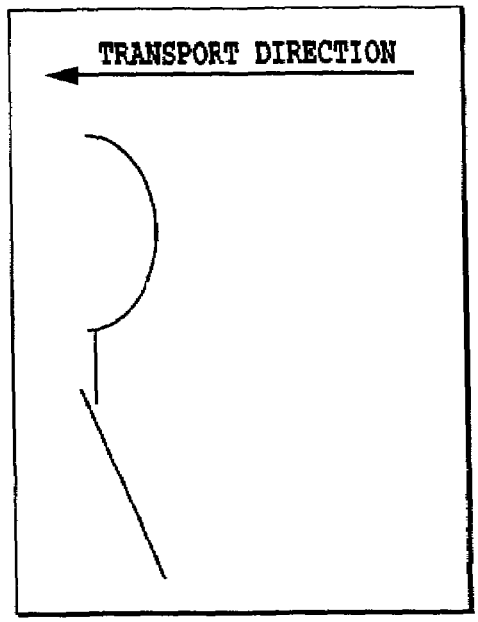

Thus, in this sub-variation, the interval of the preliminary ejecting operation is set for each of the plurality of nozzles. When the interval of the preliminary ejecting operation is controlled for each of the nozzles, it is basically determined whether or not the elapsed time after the last ejection has reached the end of the above-described predetermined time (interval), including the time (several seconds) within which the film is formed. In this determination, the last ejection may be either for the preliminary ejecting operation or for actual printing. For example, as shown in FIGS. 6A and 6B, a dot pattern formed on one page during the preliminary ejecting operation (FIG. 6B) may be along the contour of an image formed on the preceding page (FIG. 6A). Such a dot pattern of the preliminary ejecting operation may be noticeable in connection with, for example, an image formed on the same page. To prevent this, the above-described dither or random pattern can be used.

To allow the preliminary ejecting operation to form the dither pattern on the print medium, for example, each nozzle is provided with a value "D(n)" corresponding to the nozzle number "n" for the array of nozzles. Then, the preliminary ejecting operation is performed for those nozzles in which satisfy following relation: [the interval of the preliminary ejecting operation]≦[the elapsed time after the last ejection+D(n)]. The Values "D(n)" are positive or negative value determined from a predetermined dither pattern. The maximum range of deviation in the positive or negative direction for "D(n)" is determined as a value obtained by dividing the range over which dots formed during the preliminary ejecting operation are dispersed on the print medium, by the speed at which the print medium is transported. Further, instead of the values "D(n)", values determined by Correcting an Error may be used to allow the preliminary ejecting operation to form an error diffusion pattern on the print medium.

To allow the preliminary ejecting operation forming the random pattern on the print medium, for example, the interval of the preliminary ejecting operation is determined using following relation: [interval (n) of preliminary ejecting operation for the $n_{th}$ nozzle]=[basic interval of preliminary ejecting operation]+[value determined using random numbers]. Once the elapsed time after the last ejection reaches the end of the interval (n) of the preliminary ejecting operation, the preliminary ejecting operation is performed for corresponding nozzles. The interval based on random numbers has a predetermined range in the positive or negative direction as in the case with the above-described dither pattern.

In the random pattern formed during the preliminary ejecting operation, dots formed may be too close to each other or may overlap each other. In such a case, dots formed during the preliminary ejecting operation may be conspicuous. So, the interval of the preliminary ejecting operation is preferably set for each nozzle using random numbers again.

(Second Variation)

According to this second variation, in a full-line printer such as the one in the above-described first variation, a preliminary ejecting operation similar to that in the first variation is performed. However, in this variation, if dots formed on the print medium during a certain preliminary ejecting operation will be conspicuous, this operation is performed on the transportation belt, which carrying the print medium. In this case, the print head (nozzles) is not directed to the print medium but to the transport belt during the preliminary ejecting operation.

Dots formed on the print medium during the preliminary ejecting operation may be noticeable depending on the environmental conditions such as the temperature and humidity or on the ink composition conditions. That is, under certain conditions, a single ejection is not sufficient for the preliminary ejecting operation, and the duty of the preliminary ejecting operation, that is, number of ejections executed during this operation must be increased. In such a case, dots formed by a slightly larger number of ejections may be conspicuous. For example, if 8.5 pl of cyan ink is ejected through each nozzle and the OD value for solid printing is 0.3, then such dots will be conspicuous when the duty becomes 0.02 or more.

Thus, in this variation, the preliminary ejecting operation is performed on a portion of the transport belt which is located between transported print media (print sheets). That is, in the preliminary ejecting operation of this variation, the number of ejections executed on the print medium is limited so that dots formed on the print medium will not be noticeable. The number of ejections executed on the transport belt equals the essentially required number of ejections for the preliminary ejecting operation minus the number of ejections executed on the print medium. This enables the preliminary ejecting operation on the transport belt to be minimized, thereby minimizing the contamination of the transport belt or the simple cleaning mechanism which should be included in the printer of this variation. The cleaning mechanism may include a wiper blade made of an elastic body such as rubber.

(Third Variation)

The third variation, like the first variation, relates to a preliminary ejecting operation in a full-line printer. Depending on the specification of the printer or the environment in which the printer is used, time required before actual printing may exceed the time (several seconds) within which the film is formed as described in FIG. 1B. Time required before actual printing includes the time required after the cap has been detached from the print head and before printing is enabled, the time required before the print medium is transported to a print location, and the time for waiting an input of print data from the host apparatus. In such a case, if only a small number of ejections are executed during the preliminary ejecting operation, a decrease in the amount of ink ejected may not be prevented.

Thus, in this variation, once the predetermined time including the time (several seconds) within which the film is formed has elapsed, the preliminary ejecting operation is performed even when the print head is opposite the belt and not opposite the print medium. Also in this case, the interval (duration) of the preliminary ejecting operation can be set for each nozzle as described in the sub-variation of the first variation. Furthermore, in setting the predetermined time (interval) for each nozzle, corrections based on dithering or random numbers as described above are desirably used so that the contour of an image formed on the preceding page will not printed on the belt, as described in connection with FIGS. 6A and 6B.

(Fourth Variation)

The fourth variation, like the first variation, relates to a full-line printer. In this variation, the preliminary ejecting operation is performed, in the same manner as in the third variation, only for inks such as black, magenta, and cyan that are likely to form conspicuous dots. Alternatively, the preliminary ejecting operation may be performed, in the same manner as in the second variation, only for yellow, magenta, and other light-color inks having such a low color material concentration that resultant dots will be inconspicuous.

(Fifth Variation)

The fifth embodiment, like the first variation, relates to a full-line printer. In this variation, if any nozzles are not involved in image printing on the basis of the print data, the preliminary ejecting operation is not performed for these nozzles. The conventional preliminary ejecting operation or another ejection recovery process is executed at a predetermined timing for those nozzles on which the preliminary ejecting operation is not performed. This prevents undesirable dots from being formed on the print medium during the preliminary ejecting operation and also prevents the transport belt from being contaminated.

(Sixth Variation)

Figure 7:
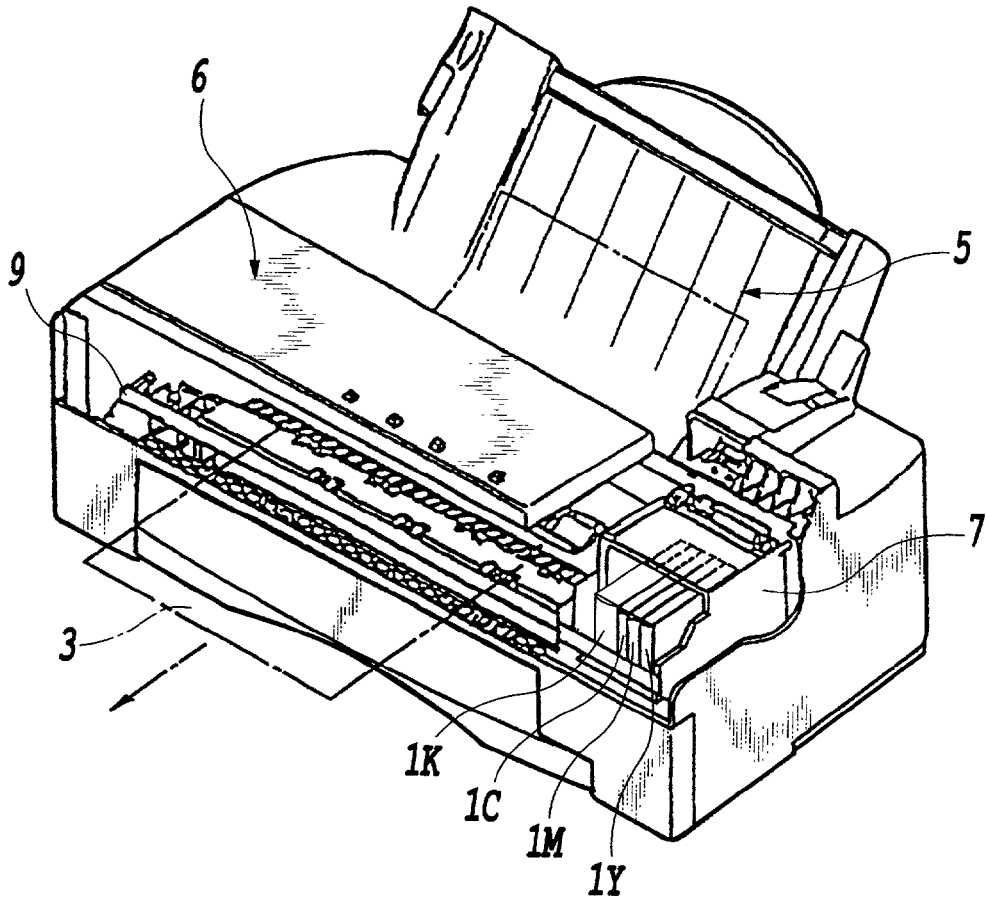
FIG. 7 is a perspective view showing a serial ink jet printer according to another variation of the embodiment of the present invention.

The sixth variation relates to a serial printer. FIG. 7 is a perspective view showing the appearance of an ink jet printer according to the sixth variation.

In FIG. 7, the print heads 1K, 1C, 1M, and 1Y for black, cyan, magenta, and yellow, respectively, are removably installed in a carriage 7. The carriage 7 is moved along a guide rail 9 by a driving mechanism (not shown) including a carriage motor, thereby allowing each of the print heads to scan the print sheet 3. Each of the print heads comprises electrothermal converting elements generating thermal energy, and uses the thermal energy to eject the ink, like the print heads in the above-described variations. In FIG. 7, the carriage is located at a home position of each print head. In the home position, the printer includes a recovery unit (not shown) with a ink receiver and the like and executes a suction recovery process, a wiping operation, or the conventional preliminary ejecting operation on the ink receiver.

The print sheet 3 (print medium) is fed from a sheet feeding section 5 and passes through a printing section including a scanning area for each of the print heads, where the medium is printed and then discharged to the front of the printer. In the printer of this variation, the preliminary ejecting operation is performed as described below.

Figures 8, 8A:
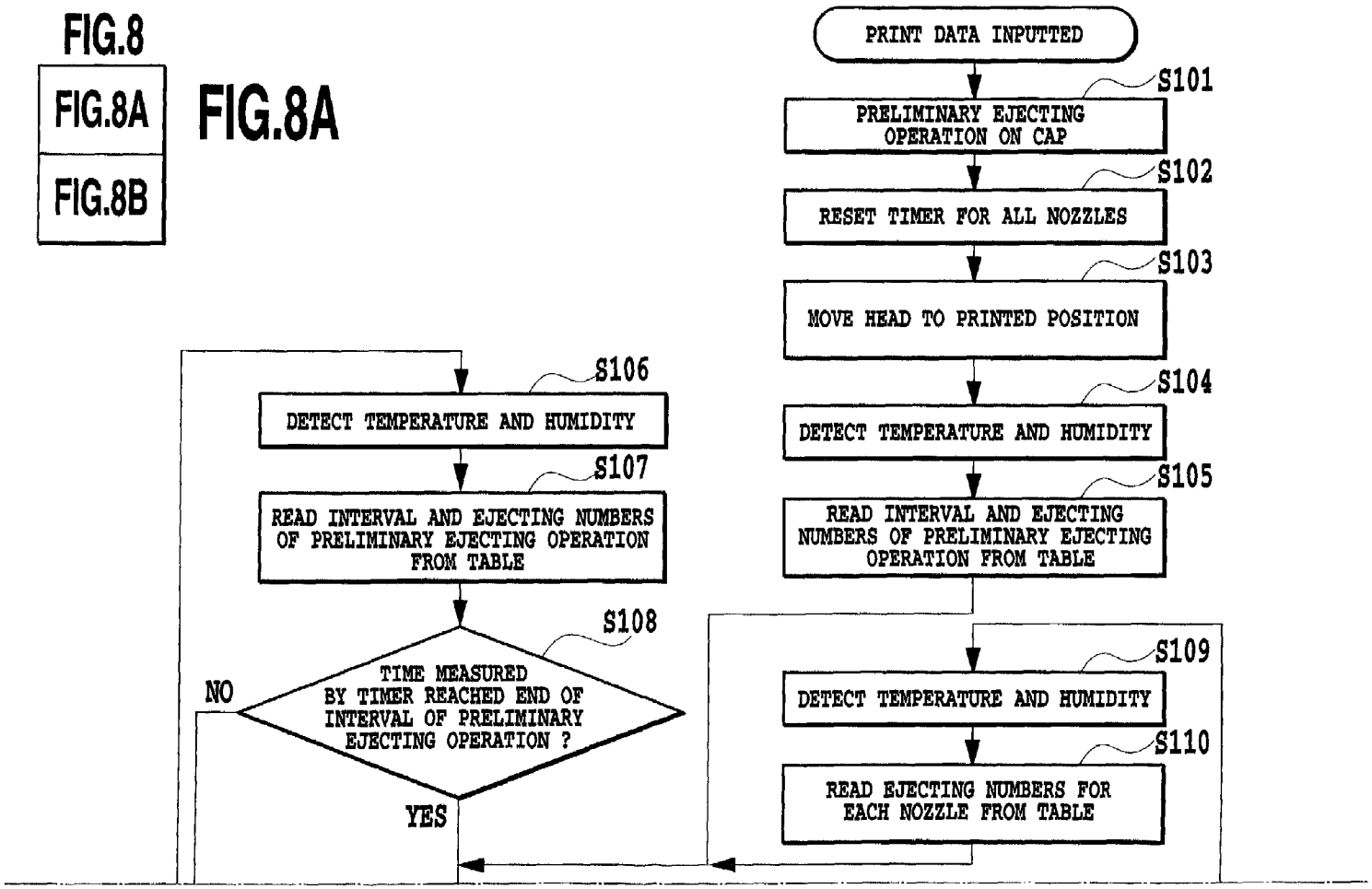
FIG. 8 is a diagram showing the relationship between FIG. 8A and FIG. 8B.
FIGS. 8A and 8B are flowcharts showing control of a preliminary ejecting operation in the printer of FIG. 7.
Figure 8B:
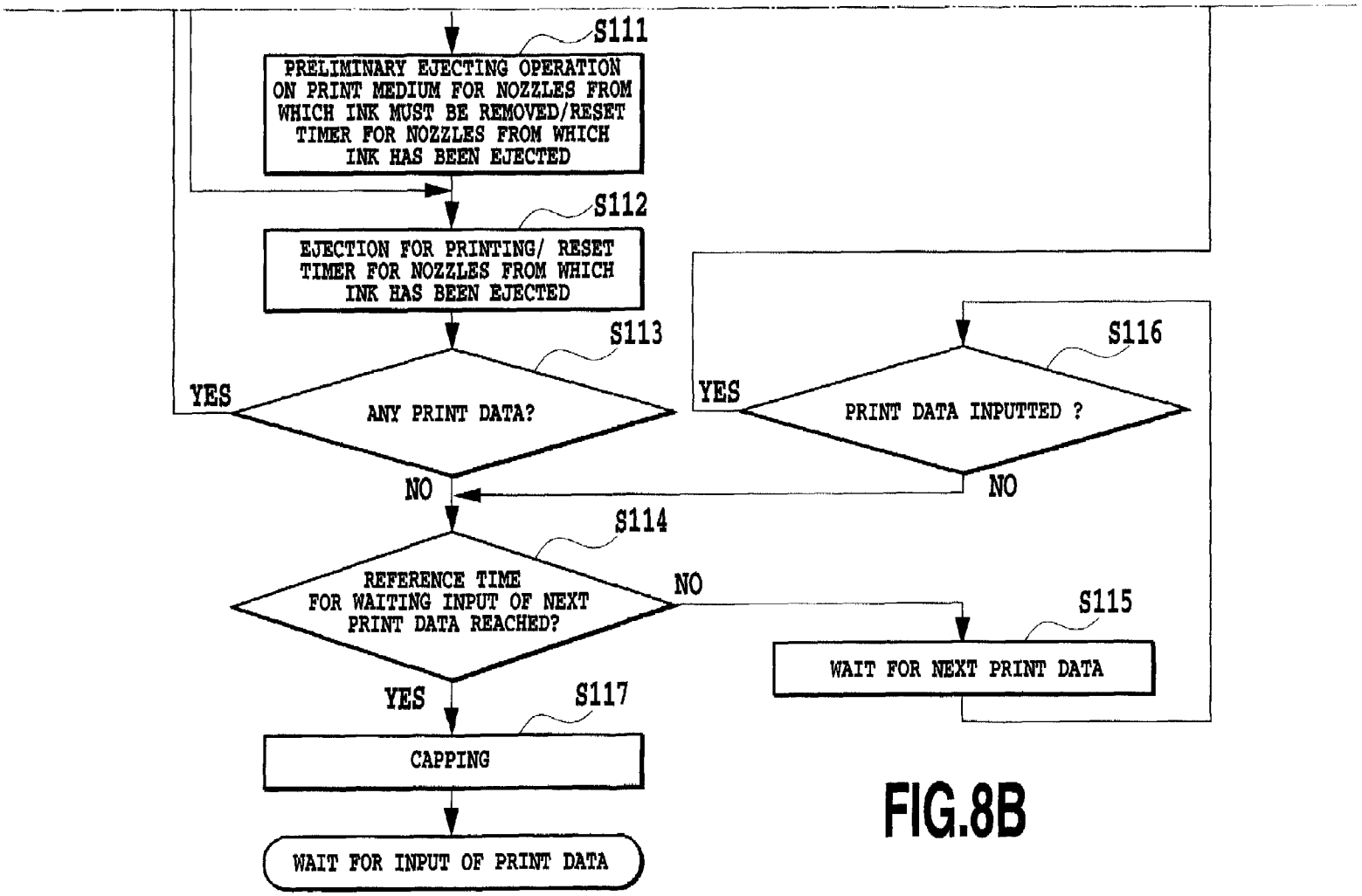

FIGS. 8A and 8B are flowcharts showing the procedure of a series of printing operations including the preliminary ejection operation of this variation. During the preliminary ejecting operation of this variation, the temperature and humidity associated with the printer are detected so that the interval and ejection numbers for the preliminary ejecting operation are read out from the tables on the basis of the detected temperature and humidity. Further, as in the sub-variation of the first variation, the elapsed time after the last ejection is measured for each of the nozzles in the print head, and the interval of the preliminary ejecting operation is set for each of the nozzles. A control system for these operations are similar to those described in FIG. 4 except for a control arrangement for scanning of the print head, and detailed description thereof is thus omitted.

This process is started when the printer receives print data from the host apparatus. First, in step S101, the conventional preliminary ejecting operation is performed in the ink receiver for each of the print heads at the home position. In step S102, a timer for the preliminary ejecting operation is reset for each of the nozzles. Thus, the elapsed time after the conventional preliminary ejecting operation starts to be counted for all the nozzles. Then, in step S103, each print head is moved from its home position to its printing start position. In step S104, the temperature and humidity are detected. In step S105, ejecting numbers for the next preliminary ejecting operation is read out from a dedicated table on the basis of the detected temperature and humidity. In this variation, as in the first variation, the dedicated table that provides an ejection number corresponding to the temperature and humidity is prepared for the preliminary ejecting operation at the start of printing because the time required before actual printing is fixed. In step S111, the preliminary ejecting operation for the start of printing executes a read-out number of ejections for all the nozzles. Furthermore, the timer is reset for those nozzles through which the ink has been ejected (in this case, all the nozzles).

During actual printing, each time the ink is ejected through the nozzles corresponding to the print data, the timer is reset for these nozzles (step S112). Thus, the elapsed time after the last ejection can be measured for the nozzles through which ink has been ejected for actual printing. That is, the preliminary ejecting operation is managed for each of the nozzles in this variation. The processing of step S112 is executed, for example, for a single scanning operation. Once a single scanning operation is completed, in step S113, it is determined whether or not there is any print data for the subsequent scanning operation.

If there is any subsequent data, then in step S106, the temperature and humidity are detected. In step S107, the interval of the preliminary ejecting operation and ejecting numbers for the operation are read out from the tables on the basis of the detected temperature and humidity. In step S108, it is determined whether or not the elapsed time measured by the timer has reached the end of the read-out interval of the preliminary ejecting operation. For those nozzles for which the elapsed time has reached the end of the interval, the preliminary ejecting operation is performed on the basis of the read-out ejecting numbers, and the timer is then reset. Thus, for those nozzles through which the ink has not been ejected for printing depending on the print data, the preliminary ejecting operation can be performed on the print sheet using the interval of the preliminary ejecting operation obtained from the table. Accordingly, for example, no preliminary ejecting operation is necessary which requires the printing operation to be suspended and the print head to be moved to a predetermined location (the ink receiver, the cap or the like) while one page is being printed. That is, the preliminary ejecting operation on the ink receiver may be performed only after the ink has been absorbed from the print head at the start of printing or the like or before or after each page is printed. This reduces the time required to move the print head to the home position (ink receiver) or the like, thereby improving the throughput.

In step S113, if it is determined that there is no print data for the next scanning operation, then in steps S114, S115, and S116, the procedure waits a certain time for the host apparatus to transmit print data to the printer. When the host apparatus transmits print data to the printer, then in steps S109 and S110, ejecting numbers for the preliminary ejecting operation is determined as in steps S104 and S105. Then, in step S111, the preliminary ejecting operation is performed for all the nozzles. On the other hand, if the printer does not receive print data within the predetermined reference time, then in step S117, the print head is moved to the home position where the cap is attached on the print head. Then, the procedure waits for print data to be input.

In this variation, the interval of the preliminary ejecting operation is managed for each nozzle. Therefore, dithering, error diffusions, or corrections based on random numbers are preferably used to set the predetermined time (interval) for each nozzle so as prevent the preliminary ejecting operation from forming a pattern along the contour of an image formed on the preceding page.

(Seventh Variation)

The seventh variation relates to a preliminary ejecting operation that is similar to the one described in FIG. 1B and which prevents a decrease in the concentration of a color material (pigment) in ink. That is, when ink containing a pigment as a color material is ejected through the nozzles in the print head, the pigment concentration of the ink may decrease within several seconds after the last ejection. Dots formed by the first ejection executed when the duration including the several seconds has elapsed have a relatively lower optical density than normal ones. In this variation, since the pigment concentration of ink returns to a normal value at an ejection following one providing a low ink concentration, the preliminary ejecting operation essentially with a single ejection is performed taking opportunity to reduce the optical density. Thus, the preliminary ejecting operation enables the normal optical of density to be achieved at the subsequent ejections.

The composition of the ink used in this variation is shown below.

[Yellow (Y) Ink]

(1) Production of a Yellow Dispersion

| | |
|---|---|
| Styrene-acrylic acid copolymer (average molecular weight: 8000) | 5.0 pts. |
| Monoethanol amine | 1.1 pts. |
| Diethylene glycol | 4.8 pts. |
| Ion exchange water | 60.0 pts. |

First, the above components were placed and mixed together in a container and was then heated at 70° C. in a water bath to completely dissolve the resin contained in the mixture. Then, 22 pts. of pigment yellow 109 and 0.8 pts. of isopropyl alcohol were added to this solution, which was then premixed for 30 minutes. Then, a dispersion process was executed under the following dispersion conditions to produce pigment dispersion:

Dispersing machine: Sand grinder
Crushed media: Zirconium beads of 1 mm diameter
Filling rate of crushed media: 50% (volume)
Crushing time: Three hours Furthermore, the dispersion obtained in this manner was subjected to a centrifugal separation process (13,000 rpm, 20 seconds) to remove large particles, thereby obtaining a yellow dispersion.

(2) Production of Ink

Yellow ink according to this variation was produced by adding the components listed below to the above yellow dispersion and sufficiently mixing and agitating these components.

| | |
|---|---|
| Above-described yellow dispersion | 35 pts. |
| Glycerin | 10 pts. |
| Diethylene glycol | 10 pts. |
| Polyethylene glycol #400 | 5 pts. |
| Ion exchange water | 40 pts. |

[Magenta (M) Ink]

(1) Production of a Magenta Dispersion

The same components as those used to produce the yellow dispersion were placed and mixed together in a container and was then heated at 70° C. in a water bath to completely dissolve the resin contained in the mixture. Then, 28 pts. of pigment red 122 and 1.0 pts. of isopropyl alcohol were added to this solution, which was then premixed for 30 minutes. Then, a dispersion process similar to that used to produce the yellow dispersion was executed to produce a magenta dispersion.

(2) Production of Ink

Magenta ink according to this variation was produced by adding the components listed below to the above magenta dispersion and sufficiently mixing and agitating these components.

| | |
|---|---|
| Above-described magenta dispersion | 30 pts. |
| Glycerin | 10 pts. |
| Diethylene glycol | 10 pts. |
| Polyethylene glycol #400 | 5 pts. |
| Ion exchange water | 45 pts. |

[Cyan (C) Ink]

(1) Production of a Cyan Dispersion

The same components as those used to produce the yellow dispersion were placed and mixed together in a container and was then heated at 70° C. in a water bath to completely dissolve the resin contained in the mixture. Then, 24 pts. of pigment blue 15:3 and 1.0 pts. of isopropyl alcohol were added to this solution, which was then premixed for 30 minutes. Then, a dispersion process similar to that used to produce the yellow dispersion was executed to produce cyan dispersion.

(2) Production of Ink

Cyan ink according to this variation was produced by adding the components listed below to the above cyan dispersion and sufficiently mixing and agitating these components.

| | |
|---|---|
| Above-described cyan dispersion | 30 pts. |
| Glycerin | 10 pts. |
| Diethylene glycol | 10 pts. |
| Polyethylene glycol #400 | 5 pts. |
| Ion exchange water | 45 pts. |
| [Black (K) Ink] | |
| Carbon black | 5 pts. |
| Glycerin | 7 pts. |
| Diethylene glycol | 5 pts. |
| Acetylenol (manufactured by Kawaken Fine Chemical) | 0.2 pts. |
| Ion exchange water | Remaining parts |

In this variation, the above inks are used in the same printer as that in the first variation to execute a process similar to the preliminary ejecting operation described in FIGS. 5A and 5B. Of course, strictly speaking, the preliminary ejecting operation in this variation has different interval and different number of ejections from that in the first variation so as to recover the pigment concentration of ink (optical density of dots) to the normal value. However, as described in FIG. 1B, the interval of the preliminary ejecting operation is basically several seconds and one or two ejections are executed during the preliminary ejecting operation in this variation. Thus, this variation is substantially similar to the first variation. Accordingly, the preliminary ejecting operation can be controlled similarly to the first variation.

As is apparent from the above description, the sub-variation of the first variation as well as the second to sixth variations are equally applicable to a decrease in concentration of ink (optical density of dots).

In the above description, only a pigment is used as a color material of ink, but the application of the present invention is not limited to the material. The ink may contain a color material other than the pigment such as dye. That is, the concentration of the pigment in ink is decreased when using ink contains dye in addition to a pigment as a color material. Accordingly, the above-described variations are applicable to a printing apparatus using ink containing a pigment the weight of which is half or more of that of the entire color material, as in the case with printing apparatuses using ink containing only a pigment as a color material.

As described above, the printers of above-described embodiments include electrothermal converting elements for each nozzle and uses thermal energy generated by these electrothermal converting elements to generate bubbles in ink. However, a printer of the present invention is not limited to this. As is apparent from the above description, the present invention is applicable to an ink jet printing apparatus including a piezoelectric element for ink ejection.

According to the present invention, the preliminary ejecting operation is performed taking opportunities in which the amount of ink ejected or the pigment concentration of ink decreases below the regular value. Accordingly, the amount of ink passing through the nozzles during the preliminary ejecting operation is smaller than the normal value. Also, the optical density of dots formed by the preliminary ejection operation is smaller than the normal value. Consequently, even if the ink is ejected onto the print medium during the preliminary ejecting operation, dots formed by the preliminary ejecting operation are not so noticeable. Further, the opportunity to reduce the amount of ink ejected or the optical density corresponds to a small number of ejections (the first ejection or the first and subsequent several ejections) executed a certain time after the last ejection. Accordingly, the amount of ink ejected during the preliminary ejecting operation can be reduced.

As a result, the number of times that the print head is moved to the ink receiver or the like for the ejection recovering processes can be reduced thereby improving the throughput of the ink jet printing apparatus. Further, according to the present invention, even if the ink is ejected onto an object other than the print medium, for example, the transport belt for the print medium during the preliminary ejecting operation, it is possible to minimize the contamination of the object such as the belt. Consequently, the cleaning mechanism is omitted or simplified so that the size and costs of the printing apparatus can be reduced.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such modifications as fall within the true spirit of the invention.

What is claimed is:

1. An ink jet printing apparatus capable of performing a preliminary ejecting operation that does not contribute to printing, said apparatus comprising:

a print head having an ejecting portion, wherein an amount of ink ejected through said ejecting portion varies depending on the amount of time during which printing is not executed, and a first preliminary ejecting operation and a second preliminary ejecting operation are performed, the first preliminary ejecting operation being performed on a print medium if the print medium lies in a printing position relative to said print head, wherein an ejection is performed through said ejecting portion of substantially only one or two ink droplets, selectively, in one preliminary ejecting operation, and the second preliminary ejecting operation, in which an ejection amount of the second preliminary ejecting operation in one preliminary ejecting operation is greater than that of the first preliminary ejecting operation, being performed on an object other than the print medium if the amount of ink decreases below a normal value before the print medium reaches the printing position.

2. The ink jet printing apparatus according to claim 1 wherein said second preliminary ejecting operation is performed in the case that said amount of ink passing through said ejecting portion is decreased below a normal value.

3. The ink jet printing apparatus according to claim 2 wherein said second preliminary ejecting operation is performed between the time when said amount of ink passing through said ejecting portion starts to decrease below said normal value and the time when said amount of ink recovers to said normal value.

4. The ink jet printing apparatus according to claim 1 wherein, if the print medium lies in the printing position when the first preliminary ejecting operation is performed, the first preliminary ejecting operation is performed on the print medium only if dots formed on the print medium may be unnoticeable compared to a printed image, and wherein said second preliminary ejecting operation is performed on an object other than the print medium if dots may be noticeable.

5. The ink jet printing apparatus according to claim 1 wherein one of said first and second preliminary ejecting operations is performed in the case that a predetermined time has elapsed after a last ejection, said predetermined time including a time during which said amount of ink passing through said ejecting portion is decreased significantly.

6. The ink jet printing apparatus according to claim 5 wherein said predetermined time is determined depending on a temperature condition and a humidity condition of said printing apparatus.

7. The ink jet printing apparatus according to claim 5 wherein said print head has a plurality of ejecting portions, and wherein said predetermined time is determined for each of said ejecting portions.

8. The ink jet printing apparatus according to claim 7 wherein said predetermined time for each of said ejecting portions is corrected using dithering, error diffusions, or random numbers so that a dot pattern formed during one of said first and second preliminary ejecting operations for said plurality of ejecting portions is unnoticeable compared to a printed image.

9. The ink jet printing apparatus according to claim 5 further comprising:

a table used to determine said predetermined time and ejecting numbers for one of said first and second preliminary ejecting operations, and a control device for controlling said one of said first and second preliminary ejecting operations, said control device using said table to perform said one of said first and second preliminary ejecting operations.

10. The ink jet printing apparatus according to claim 1 wherein said print head includes an electrothermal converting element, said print head ejecting ink using thermal energy generated by said electrothermal converting element.

11. The ink jet printing apparatus according to claim 1 wherein said print head includes a piezoelectric element, said print head ejecting ink using mechanical energy generated by said piezoelectric element.

12. An ink jet printing apparatus according to claim 1, further comprising a carriage configured and positioned to scan said print head, and wherein the first preliminary ejecting operation is performed during scanning of said print head.

13. A preliminary ejecting method for an ink jet printing apparatus comprising a print head having an ejecting portion, the apparatus being capable of performing a preliminary ejecting operation that does not contribute to printing, wherein an amount of ink ejected through the ejecting portion varies depending on the amount of time during which printing is not executed, said method comprising the steps of:

performing a first preliminary ejecting operation on a print medium if the print medium lies in a printing position relative to the print head, wherein an ejection is performed through the ejecting portion of substantially only one or two ink droplets, selectively, in one preliminary ejecting operation, and performing a second preliminary ejecting operation, in which an ejection amount of the second preliminary ejecting operation in one preliminary ejecting operation is greater than that of the first preliminary ejecting operation, on an object other than the print medium if the amount of ink decreases below a normal value before the print medium reaches the printing position.

14. The preliminary ejecting method according to claim 13 wherein said one or two ejections are performed when said amount of ink passing through said ejecting portion is decreased below a normal value.

15. The preliminary ejecting method according to claim 14 wherein said second preliminary ejecting operation is performed between the time when said amount of ink passing through said ejecting portion starts to decrease below said normal value and the time when said amount of ink recovers to said normal value.

16. The preliminary ejecting method according to claim 13 wherein, if the print medium lies in the printing position when the first preliminary ejecting operation is performed, the first preliminary ejecting operation is performed on the print medium only if dots formed on the print medium may be unnoticeable compared to a printed image, and wherein the second preliminary ejecting operation is performed on an object other than the print medium if dots may be noticeable.

17. The preliminary ejecting method according to claim 13 wherein one of said first and second preliminary ejecting operations is performed when a predetermined time has elapsed after a last ejection, said predetermined time including a time during which the amount of ink passing through said ejecting portion is decreased significantly.

18. The preliminary ejecting method according to claim 17 wherein said predetermined time is determined depending on a temperature condition and a humidity condition of said printing apparatus.

19. The preliminary ejecting method according to claim 17 wherein said print head has a plurality of ejecting portions, and wherein said predetermined time is determined for each of said ejecting portions.

20. The preliminary ejecting method according to claim 19 wherein said predetermined time for each of said ejecting portions is corrected using dithering, error diffusions, or random numbers so that a dot pattern formed during one of said first and second preliminary ejecting operations for said plurality of ejecting portions is unnoticeable compared to a printed image.

21. An ink jet printing apparatus capable of performing a preliminary ejecting operation that does not contribute to printing, said apparatus comprising:

a print head having an ejecting portion;

wherein a first preliminary ejecting operation and a second preliminary ejecting operation are performed, the first preliminary ejecting operation being performed on a print medium lying in a position facing said print head, wherein an ejection is performed through said ejecting portion of substantially only one or two ink droplets, selectively, in one preliminary ejecting operation, and the second preliminary ejecting operation, in which an ejection amount of the second preliminary ejecting operation in one preliminary ejecting operation is greater than that of the first preliminary ejecting operation, being performed on an object other than the print medium.

22. An ink jet printing apparatus according to claim 21, further comprising a carriage configured and positioned to scan said print head, and wherein the first preliminary ejecting operation is performed during scanning of said print head.

23. An ink jet printing apparatus according to claim 21, wherein the second preliminary ejecting operation is performed at the start of a printing operation and the first preliminary ejecting operation is performed during the printing operation on the printing medium.

24. An ink jet printing apparatus according to claim 21, wherein the number of ejected ink droplets of the second preliminary ejecting operation in one preliminary ejecting operation is greater than that of the first preliminary ejecting operation.

25. An ink jet printing apparatus according to claim 21, wherein the first preliminary ejecting operation is performed at predetermined time intervals.

* * * * *

UNITED STATES PATENT AND TRADEMARK OFFICE

CERTIFICATE OF CORRECTION

PATENT NO. : 7,029,095 B2
APPLICATION NO. : 09/986804
DATED : April 18, 2006
INVENTOR(S) : Hitoshi Tsuboi et al.

It is certified that error appears in the above-identified patent and that said Letters Patent is hereby corrected as shown below:

COLUMN 1
Line 49, “so-called a” should read --a so-called--.

COLUMN 5
Line 29, “preformed” should read --performed--.
Line 50, “ejection(first” should read --ejection (first--.

COLUMN 6
Line 31, “twice” should read --double--.

COLUMN 8
Line 36, “till” should read --in--.
Line 45, “atone.” should read --at once--.

COLUMN 9
Line 33, “ejection” should read --ejections--.

COLUMN 10
Line 24, “nozzles” should read --capped nozzles.--
Line 25, “capped.” should be deleted.

COLUMN 12
Line 56, “numbers” should read --number--.
Line 66, “is” should read --are--.

COLUMN 13
Line 18, “ejecting” should read --ejecting operation--.

COLUMN 14
Line 8, “relatively” should read --a relatively--.

COLUMN 15
Line 65, “in” should be deleted.

COLUMN 16
Line 38, “carrying” should read --carries--.

UNITED STATES PATENT AND TRADEMARK OFFICE

CERTIFICATE OF CORRECTION

PATENT NO. : 7,029,095 B2
APPLICATION NO. : 09/986804
DATED : April 18, 2006
INVENTOR(S) : Hitoshi Tsuboi et al.

It is certified that error appears in the above-identified patent and that said Letters Patent is hereby corrected as shown below:

COLUMN 17
Line 15, “waiting” should read --wait for--.
Line 31, “printed” should read --be printed--.

COLUMN 19
Line 29, “is” should read --are--.
Line 41, “prevent” should read --to prevent--.
Line 59, “a” (first occurrence) should read --at--.
Line 63, “of” should be deleted.

COLUMN 20
Line 12, “was” should read --were--.
Line 47, “was” should read --were--.

COLUMN 21
Line 5, “was” should read --were--.
Line 56, “contains” should read --containing--.
Line 65, “uses” should read --use--.

COLUMN 22
Line 24, “throughpu” should read --throughput--.
Line 64, “claim 1” should read --claim 1,--.

COLUMN 23
Line 1, “claim 2” should read --claim 2,--.
Line 7, “claim 1” should read --claim 1,--.
Line 16, “claim 1” should read --claim 1,--.
Line 23, “claim 5” should read --claim 5,--.
Line 27, “claim 5” should read --claim 5,--.
Line 31, “claim 7” should read --claim 7,--.
Line 38, “claim 5” should read --claim 5,--.
Line 47, “claim 1” should read --claim 1,--.
Line 51, “claim 1” should read --claim 1,--.

UNITED STATES PATENT AND TRADEMARK OFFICE

CERTIFICATE OF CORRECTION

PATENT NO. : 7,029,095 B2
APPLICATION NO. : 09/986804
DATED : April 18, 2006
INVENTOR(S) : Hitoshi Tsuboi et al.

It is certified that error appears in the above-identified patent and that said Letters Patent is hereby corrected as shown below:

COLUMN 24

Line 16, “13 wherein” should read --13, wherein--.
Line 20, “14 wherein” should read --14, wherein--.
Line 26, “13 wherein.” should read --13, wherein--.
Line 34, “13 wherein.” should read --13, wherein--.
Line 40, “17 wherein” should read --17, wherein--.
Line 45, “17 wherein” should read --17, wherein--.
Line 49, “19 wherein” should read --19, wherein--.

Signed and Sealed this

Thirtieth Day of January, 2007

JON W. DUDAS
*Director of the United States Patent and Trademark Office*